US006719514B1

(12) United States Patent
Mensink

(10) Patent No.: US 6,719,514 B1
(45) Date of Patent: Apr. 13, 2004

(54) PROCESS FOR PRODUCING A METAL CAN WITH AN INSERT PIECE FOR PACKAGING, FOR EXAMPLE, A FOODSTUFF, AND A CAN OF THIS NATURE

(75) Inventor: Johannes Lambertus Maria Mensink, Lier (BE)

(73) Assignee: Corus Staal BV, Ijmuiden (NL)

( * ) Notice: Subject to any disclaimer, the term of this patent is extended or adjusted under 35 U.S.C. 154(b) by 0 days.

(21) Appl. No.: 09/600,196

(22) PCT Filed: Jan. 18, 1999

(86) PCT No.: PCT/EP99/00135

§ 371 (c)(1),
(2), (4) Date: Sep. 5, 2000

(87) PCT Pub. No.: WO99/37420

PCT Pub. Date: Jul. 29, 1999

(30) Foreign Application Priority Data

Jan. 21, 1998 (NL) ..... 1008077

(51) Int. Cl.[7] ..... B21D 51/26

(52) U.S. Cl. ..... 413/4; 62/293; 126/262; 220/600; 220/615

(58) Field of Search ..... 220/619, 615, 220/592.16, 604, 620, 601, 612, 600; 62/293; 126/262; 413/4

(56) References Cited

U.S. PATENT DOCUMENTS

| | | | | | |
|---|---|---|---|---|---|
| 2,382,378 | A | * | 8/1945 | Peerman | 220/310.1 |
| 2,464,506 | A | | 3/1949 | Hirschfeld | |
| 2,994,456 | A | * | 8/1961 | Peerman | 220/619 |
| 3,257,821 | A | * | 6/1966 | Warner | 62/371 |
| 3,369,369 | A | * | 2/1968 | Weiss | 62/4 |
| 3,373,581 | A | * | 3/1968 | Strader | 62/294 |
| 3,494,143 | A | | 2/1970 | Barnett et al. | |
| 3,774,560 | A | * | 11/1973 | Hartz | 413/6 |
| 4,037,550 | A | * | 7/1977 | Zofko | 413/6 |
| 4,055,271 | A | * | 10/1977 | Kronenwetter et al. | 220/62.22 |
| 4,089,283 | A | * | 5/1978 | Mertens et al. | 220/619 |
| 4,254,886 | A | * | 3/1981 | Van Doren | 220/658 |
| 4,584,848 | A | | 4/1986 | Barnett | |
| 4,925,470 | A | * | 5/1990 | Chou | 62/4 |
| 4,981,022 | A | | 1/1991 | Snyder | |
| 5,072,605 | A | * | 12/1991 | Imazu et al. | 72/46 |
| 5,214,933 | A | | 6/1993 | Aitchison et al. | |
| 5,765,714 | A | * | 6/1998 | Nakano et al. | 220/619 |
| 5,865,036 | A | * | 2/1999 | Anthony | 62/293 |
| 6,070,750 | A | * | 6/2000 | Kubitz | 220/62.22 |

FOREIGN PATENT DOCUMENTS

| | | |
|---|---|---|
| FR | 513015 | * 10/1920 |
| WO | 9629255 | 9/1996 |

* cited by examiner

*Primary Examiner*—Lee Young
*Assistant Examiner*—Joseph C. Merek
(74) *Attorney, Agent, or Firm*—Stevens, Davis, Miller & Mosher, LLP

(57) ABSTRACT

A process for producing a metal can, having a cylindrical body, a base and a lid, of the type in which the base has a cylindrical recess which projects into the inside of the can, in which process: a) a combination of a body and a base is produced, by deep-drawing and wall stretching, from metallic and/or plastic-coated metal sheet which is suitable for cans; b) an insert piece, which is tubular in shape so as to correspond to the cylindrical recess and is closed on one side, is produced from corresponding metal sheet by deep-drawing or spinning, followed by wall stretching; c) a hole which is narrower than the open side of the insert piece is made in the base of the body-base combination; d) the edge of the hole is flanged until it acquires a bearing surface which is able to fit together with the edge of the open side of the insert piece; c) the edge of the hole and the edge of the open side of the insert piece are joined together.

9 Claims, 2 Drawing Sheets

PROCESS FOR PRODUCING A METAL CAN WITH AN INSERT PIECE FOR PACKAGING, FOR EXAMPLE, A FOODSTUFF, AND A CAN OF THIS NATURE

FIELD OF THE INVENTION

The invention relates to the production of a metal can, comprising a cylindrical body, a base and a lid, of the type in which the base has a cylindrical, or virtually cylindrical, recess which projects into the inside of the can. The invention also relates to metal cans of this nature.

Where the following text refers to a can, what is meant, in the first instance, is a can which is suitable for packaging foodstuffs, such as drinks or food.

BACKGROUND OF THE INVENTION

However, the invention is also deemed to relate to the production of a can which is intended to hold different contents.

SUMMARY OF THE INVENTION

A new development in the use of cans consists in the fact that a need has arisen for cans which are provided with means for heating or cooling them. If such cans are taken to places where there are no facilities for heating or cooling the contents of the can, such added features still allow the contents of the can to be brought to the desired temperature.

Numerous proposals have been made for designs in which a heating or cooling element is situated in the can, in which case the heating or cooling element can be activated by external means.

For various reasons, there is a need for an embodiment of a can of this nature in which the heating or cooling element is situated outside the actual contents of the can, so that there is no risk of the contents of the can coming into contact with chemicals. By, way of example, it is proposed in patent WO-9629255 to design the base with a cylindrical recess which projects into the inside of the can. If this recess is large enough, an element for cooling or heating the contents of the can can be placed therein.

Different therefrom patent U.S. Pat. No. 3,494,143 describes a can in which a cooling or heating cartridge is built-in in the can. The cartridge is affixed by folded seams to the interior side of the separate base of the can. This results in a complicated construction with the further disadvantage that any leakage from the cartridge through the folded seem mixes up with the contents of the can. The present invention relates to a novel method for the production of a metal can provided with such a recess in the base, and to a can of this nature. The object of the invention is to provide a simple design which follows on from known production techniques for, for example, metal drinks cans and in which the weight of the can is very low. The present invention also has the object to obviate disadvantages of known constructions.

The invention therefore consists in the fact that, in the method mentioned in the preamble:

a) a combination of a body and a base is produced, by deep-drawing and wall stretching, from metallic and/or plastic-coated metal sheet which is suitable for cans;

b) an insert piece, which is tubular in shape so as to correspond to the cylindrical recess and is closed on one side, is produced from corresponding metal sheet by deep-drawing or spinning, followed by wall stretching;

c) a hole which is narrower than the open side of the insert piece is made in the base of the body-base combination;

d) the edge of the hole is flanged until it acquires a bearing surface which is able to fit together with the edge of the open side of the insert piece;

the edge of the hole and the edge of the open side of the insert piece are joined together.

It will be clear that after the can has been filled, the lid is attached to that side of the body which is remote from the base.

Where a cylindrical recess is referred to, this is also understood to encompass recess shapes which differ only slightly from a true cylinder, for example recesses which taper slightly.

It should be noted that the above-mentioned step a) corresponds to the production of a body-base combination for a so-called two-part can. This is therefore entirely compatible with widely used techniques for producing cans in vary large quantities. In fact, the above-mentioned step b) also employs the same technique on a component which has only a slightly different shape. As a result, all the experience in producing cans which has been gained can be employed so as to obtain a weight which is as low as possible. After production, cans are often also provided with a protective coating on the inside. When using the novel process, it is preferable to provide the outer surface of the insert piece with the same protective coating as that which is customarily applied to the inside of the can. If suitable equipment is available, it is obviously conceivable to apply the protective coating after the edge of the hole and the edge of the insert piece have been joined together. However, it will often be preferable to provide the inside of the can with the protective coating before a hole is made in the base and to provide the outside of the insert piece with the coating before the edge of the hole and the edge of the insert piece are joined together.

A suitable method according to the invention for joining together the insert piece and the edge of the hole has proven to be one in which firstly the edge of the hole is flanged outwards, and then the edges of the open side of the insert piece and of the hole are both beaded and then folded together. It should be noted that joining edges by means of beading and folding is a method which is known and has been tried and tested, and therefore does not need to be described in more detail. It is, however, preferable first of all to arrange a sealing compound, which is known per se, in the beaded edge of the insert piece, before the bead edges are folded together. This sealing compound ensures that the contents of the can cannot be contaminated from outside via the folded-together bead edge.

The most simple way of beading the edge of the hole and folding together the edge of the hole and the edge of the insert piece is if the flanged edge of the hole extends beyond, in the axial direction, that point of the base which projects furthest. However, it is undesirable for the folded-together edge ultimately to project so far that it will then have to serve as the support edge of the filled can, since in many cases this is considered undesirable. Therefore, it is preferred, after the folding operation has been carried out, to press the folded-together edge towards the can as far as beyond that point of the base which projects furthest in the axial direction.

According to another method for joining the edge of the hole and the edge of the insert piece, the edge of the hole is firstly flanged towards the inside of the can, after which the flanged edge of the hole and/or the edge of the open side of the insert piece are provided with adhesive and are then joined together.

According to the invention, by pushing the edge of the open side of the insert piece around the flanged edge of the hole until it bears against the base of the can, the insert piece and can body can be positioned very accurately and uniformly with respect to one another.

The invention relates not only to the process described but also to a metal can comprising a cylindrical body, a base and a lid, of the type in which the base has a cylindrical recess which projects into the inside of the can. According to the invention, this known can is designed in such a manner that the body and that part of the base which lies outside the recess comprise a single piece which is delimited by the edge of a hole in the base, which edge is flanged in the axial direction, and in that a tubular insert piece which forms the recess and is closed on one side has an edge which fits against the flanged edge of the hole and is joined thereto. In this novel can, the outer surface of the insert piece is preferably provided with the same protective coating which is customarily applied to the inside of the can. As has already been described above with reference to the description of the production of the novel can, the edge of the hole can be flanged towards the contents of the can, the edges of the open side of the insert piece and of the hole both being beaded and then folded together. In this case, a sealing compound may be present in the fold seam.

In a preferred embodiment of the novel can, the fold seam of the folded-together edges is located, in the direction of the can, beyond that point of the base which projects furthest in the axial direction.

In another embodiment of the novel can, the edge of the hole is flanged towards the inside of the can, in which case the flanged edge of the hole and/or the edge of the open side of the insert piece are joined together by means of adhesive. In this case, the open side of the insert piece is preferably pushed around the flanged edge of the hole until it bears against the base of the can.

BRIEF DESCRIPTION OF THE DRAWINGS

The invention will now be explained with reference to a number of figures. Since all the figures relate to symmetrical cylinder configurations, only half of this configuration is shown in each of the figures.

DETAILED DESCRIPTION OF THE PREFERRED EMBODIMENTS

Figure 1:
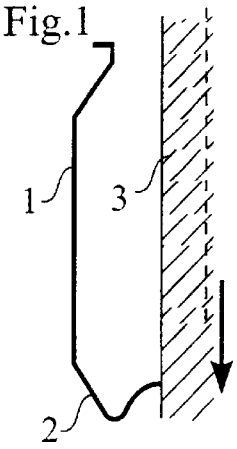
FIGS. 1, 2 and 3 show successive working steps for the production of a body-base combination of a can.
Figure 2:
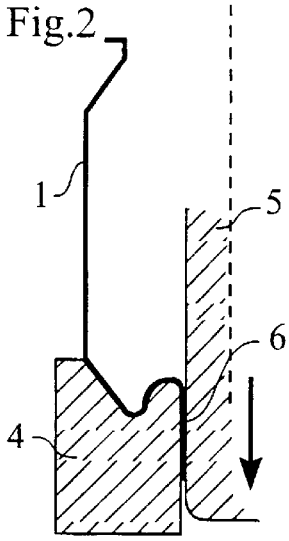
Figure 3:
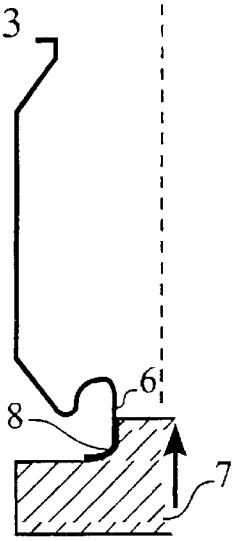

In FIG. 1, reference numeral 1 denotes the body of a body-base combination of a can, which is formed by deep-drawing and wall stretching. Reference numeral 2 denotes the base. A hole is cut in base 2 by means of a punch 3 which is moved in the direction of the arrow. FIG. 2 illustrates how the edge 6 of this hole is flanged outwards. To this end, the outer edge of the base 2 is supported by support block 4, while a ram 5 is moved downwards in the direction of the arrow. FIG. 3 illustrates how the end of the flanged edge 6 is formed into a bead edge 8, by moving a shaping die 7 in the direction of the arrow.

Figure 4:
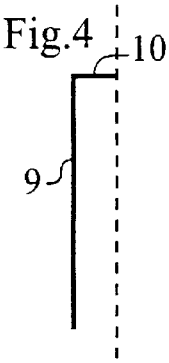
FIGS. 4, 5, 6 and 7 show successive production steps for the production of an insert piece.
Figure 5:
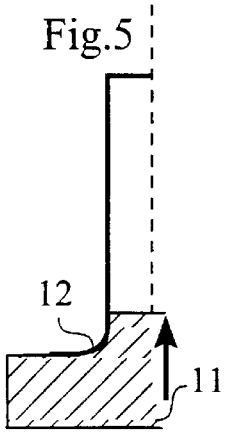
Figure 6:
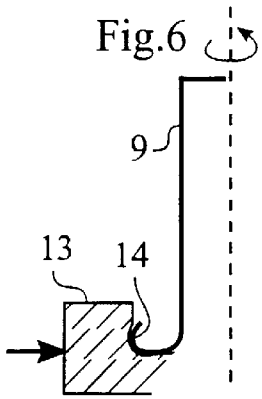

FIG. 4 shows a starting product which is used for the production of an insert piece. This starting product comprises a body 9 and a base 10. This starting product is formed in a manner which is known in the prior art by successively deep-drawing or spinning a metal sheet and then stretching the walls. FIG. 5 illustrates how the edge 12 of the insert piece is flanged with the aid of a shaping die 11 which is moved in the direction of the arrow. By pressing a forming tool 13 against the flanged edge 12, while the insert piece is being rotated about its axis, a bead edge 14 (cf. FIG. 6) is formed.

Figure 7:
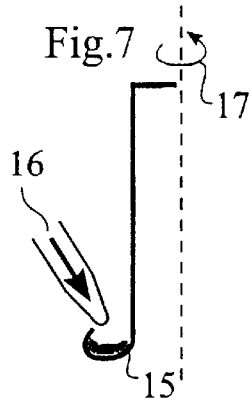

Using a spray gun 16, a sealing compound 15 is arranged in the bead edge, while the insert piece is being rotated. See arrow direction 17 in FIG. 7.

Figure 8:
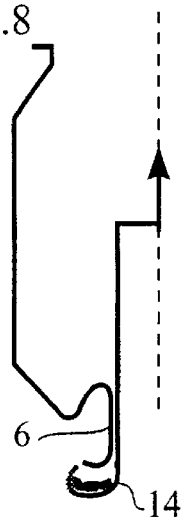
FIGS. 8, 9 and 10 show production steps for joining together parts of the finished can.
Figure 9:
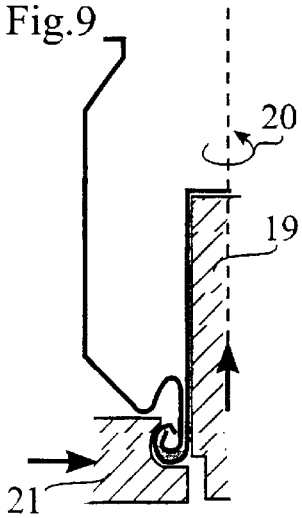

FIG. 8 illustrates how the insert piece containing the sealing compound is pushed into the flanged edge 6 of the hole, after which ram 19 and folding tool 21 are used to convert the beaded edges 14 and 8 into a fold seam (cf. FIG. 9). As seen in FIG. 8 at this stage the beaded edges 14 and 8 are concave. Finally, FIG. 10 illustrates how the fold seam which has been formed is pressed back until it is above the outermost edge of the base with the aid of ram 22 and blank holder 23.

Figure 10:
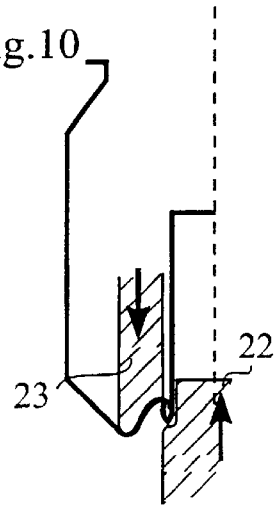
Figure 11:
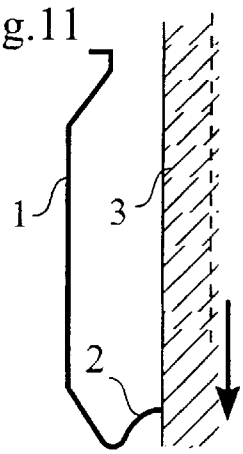
FIGS. 11 and 12 show successive production steps for an alternative embodiment of a body-base combination.

As seen in FIG. 10, the insert can is empty. Thus, it does not yet include a heating or cooling element.

FIGS. 11 to 15 illustrate a different method of joining the edge of the hole in the base 2 and the insert piece. In this context, FIG. 11 corresponds to FIG. 1, and FIG. 13 corresponds to FIG. 4.

Figure 12:
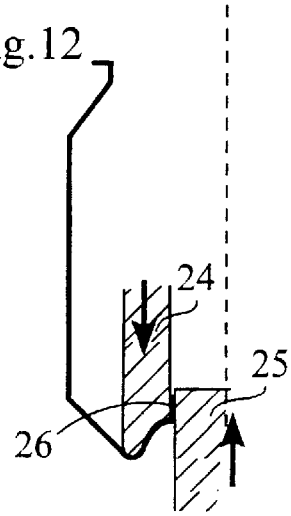

In contrast to FIG. 2, FIG. 12 illustrates a working step in which the edge 26 of the hole which has been formed is flanged towards the inside of the can which is to be formed. To do this, a blank holder 24 is put in place and a ram 25 is moved in the direction of the arrow.

Figure 13:
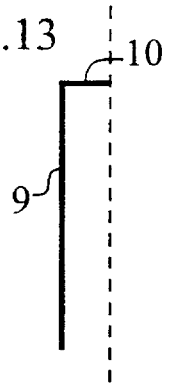
FIG. 13 shows the production of an insert piece.
Figure 14:
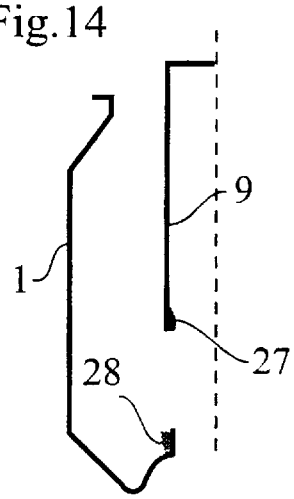
FIGS. 14 and 15 show successive production steps for an alternative method of joining together the parts which form a can.
Figure 15:
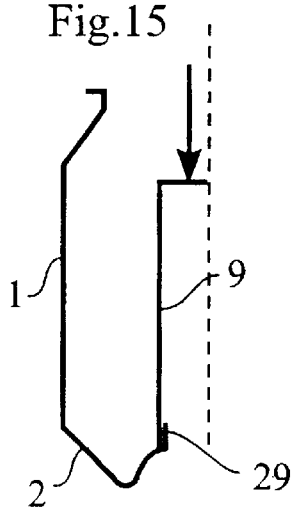

After the insert piece has been produced, as illustrated in FIG. 13, this insert piece is not subjected to any further mechanical working. However, adhesive is applied to the inside of the edge of the insert piece and to the outwardly directed side of the flanged edge 26 (cf. reference numerals 27 and 28). FIG. 15 shows how the edge of the insert piece is pushed around the flanged edge of the hole and is pressed onto the base 2, after which the seam of adhesive 29 is able to harden.

What is claimed is:

1. A process for producing a metal can, comprising a cylindrical body, a base and a lid, in which the base has a cylindrical recess which projects into the inside of the can, in which process a) a combination of a body and a base is produced, by deep-drawing and wall stretching, from metallic and/or plastic coated metal sheet which is suitable for cans, wherein the body and the base are formed from a single structure;

b) a tubular insert-piece, which forms the cylindrical recess and has opposed a first closed end and a second open end, is produced from corresponding metal sheet by deep-drawing or spinning, followed by wall stretching;

c) a hole which is narrower than the open end of the insert piece is made in the base of the body-base combination;

d) the edge of the hole is flanged until the edge of the hole acquires a bearing surface which is able to fit together with the edge of the open end of the insert piece; and e) the insert piece is inserted into the hole and the edge of the hole and the edge of the open end of the insert piece are joined together directly;

wherein the edge of the hole is beaded before the insert piece is inserted into the hole and joined to the edge of the hole;

wherein the closed end of the insert piece is inserted into the hole before any other portion of the insert piece is inserted into the hole.

2. The process according to claim 1, wherein the edge of the hole is flanged outwards, and the edges of the open end of the insert piece and of the hole are both beaded, then the insert piece is inserted into the hole, and then the open side of the insert piece and of the hole are folded together, wherein the insert piece having a beaded edge is inserted into the hole having a flanged and beaded edge.

3. The process according to claim 2, wherein sealing compound is arranged in the beaded edge of the insert piece, before the bead edges are folded together.

4. The process according to claim 2, wherein the folded-together edge is pressed towards the can as far as beyond that point of the base which projects furthest in the axial direction.

5. The process according to claim 3, wherein the folded-together edge is pressed towards the can as far as beyond that point of the base which projects furthest in the axial direction.

6. The process according to claim 1, further comprising inserting an external heating or cooling element comprising a container containing heating cooling material into the insert piece.

7. The process according to claim 1, wherein the insert piece is empty.

8. The process of claim 2, wherein the edge of the hole and the edge of the second end of the insert piece, prior to being directly joined together, extend axially outwards from the body of the can to a plane external to the body of the can;

the tubular insert piece having cylindrical sidewalls and the opposed first and second ends, the tubular insert piece being closed on the first of the opposed ends by an insert piece base and on the second of the opposed ends has an edge which fits directly again the flanged edge of the hole and is joined thereto at a joint, wherein the insert piece has a constant diameter along its entire length between the insert piece base and the joint.

9. The process of claim 1, wherein the bead forms a curve in a radial direction.

* * * * *